US005960558A

United States Patent [19]

Bourgault

[11] Patent Number: 5,960,558

[45] Date of Patent: Oct. 5, 1999

[54] GRAIN DRYING SYSTEM AND METHOD

[76] Inventor: Pierre Bourgault, 21 Armour St., Aylmer, Canada, J9H 5M9

[21] Appl. No.: 09/100,480

[22] Filed: Jun. 19, 1998

[30] Foreign Application Priority Data

Sep. 2, 1997 [CA] Canada ..... 2214352

[51] Int. Cl.[6] ..... F26B 3/00

[52] U.S. Cl. ..... 34/495; 34/77; 34/493; 34/491

[58] Field of Search ..... 34/233, 232, 218, 34/219, 168, 169, 491, 493, 509, 549, 551, 560, 77, 494, 495, 82; 110/101 R, 102, 267, 344; 432/29, 37

[56] References Cited

U.S. PATENT DOCUMENTS

| | | | |
|---|---|---|---|
| 4,020,565 | 5/1977 | Steffen | 34/93 |
| 4,043,051 | 8/1977 | Lussenden | 34/77 |
| 4,205,456 | 6/1980 | Ayers et al. | 34/515 |
| 4,257,169 | 3/1981 | Pierce | 34/471 |
| 4,558,523 | 12/1985 | Isbell | 34/491 |
| 4,583,300 | 4/1986 | Mast | 34/557 |
| 4,593,628 | 6/1986 | Henry | 110/101 |
| 4,800,653 | 1/1989 | Steffen | 34/495 |
| 5,326,543 | 7/1994 | Fiorenzano, Jr. | 422/292 |

FOREIGN PATENT DOCUMENTS 1089952 11/1980 Canada .

*Primary Examiner*—Henry Bennett
*Assistant Examiner*—Pamela A. Wilson
*Attorney, Agent, or Firm*—Renner, Otto, Boisselle & Sklar, P.L.L.

[57] ABSTRACT

A in-bin grain drying system is the subject of the present invention. A boiler having a variable capacity Btu output heats an ethylene glycol/water heating fluid which is circulated through hydronic coils. Fans move ambient air through the hydronic coils and the dry heated air is circulated to the plenum of the grain bin. The air which enters the bin is less moisture laden than in other drying systems, particularly those which are heated by propane flame. The temperature of the returning fluid is sensed and a fuel supply controller adjusts the amount of fuel supplied to the boiler and thus the Btu output. Accordingly the desired temperature of the air entering the plenum chamber is constant regardless of ambient outside temperature or relative humidity.

16 Claims, 5 Drawing Sheets

GRAIN DRYING SYSTEM AND METHOD

FIELD OF INVENTION

This invention relates to an apparatus and method for drying grain. More particularly this invention relates to the drying of grain in grain bins.

BACKGROUND

Out of necessity the practice of harvesting grain which is relatively damp, and subsequently drying it, is now extensive in western Canada and the mid-western plains of the United States. The practice continues to grow. Farmers operate on ever-narrowing gross profit margins. If they are to remain competitive in an increasingly global economy with more selective buyers they must seek to maximize net revenue through improved grades, avoidance of spoilage, and minimizing labour, energy, and other costs. Because the harvesting season represents such a small but critical portion of the calendar year, extending it by even a few days each year can increase the production capacity of a farm operation by a very significant amount.

Acquiring the capability to dry grain efficiently and reliably will help to improve crop grade and provide some degree of insurance against a late, wet harvesting season. Farm capacity can be increased greatly with a relatively small investment.

The most common method of drying grain is through the use of out-of-bin dryers, both batch and continuous flow. These are extensively used in the drying of corn, soya beans and certain other crops in eastern Canada, and in eastern and mid-western United States. However, these methods have not found favor with growers in western Canada and the north-western United States because drying in this way is relatively costly and labour intensive.

There are a number of current grain drying practices. The first could be considered in-bin aeration without auxiliary heat. This probably is the most extensively used method of drying and grain storage control. In warm, dry weather it can be an effective and inexpensive means of drying grain. However, as the temperature cools in late fall, the drying rate becomes extremely slow and the cost of running the fan alone can exceed the costs of drying grain using auxiliary heat. When the season is advanced to a point where little or no drying occurs, aeration fans are used to cool or freeze the grain, and thus buy time to deal with the problem in the spring.

In-bin drying of grain using a supplementary fossil fuel source of heat provides a more reliable means of drying. Current practice is to use in-line natural gas or propane burners that leave all of the products of combustion in the airstream. It must also be kept in mind that in a direct in-line burner using natural gas, 3.5 lb. of water is added to the air for every cubic meter of natural gas consumed. At the start of drying, most of this condenses in the grain and it is then pushed through the grain as the drying front advances. Because of the additional water the leading edge of the drying front can become wetter than the original wet grain. In extreme cases this can interfere with the flow of air through the grain. Because of the existence of flames in what is a flammable environment, gas, oil or natural gas dryers present a fire risk and require constant supervision.

Because high temperatures favour the growth of mold, bacteria, and insects, the temperature of the grain in those portions of the bin that contain damp grain cannot be allowed to get too high. Warm and dry air rising through the dry layers of grain will stay at or near its initial temperature and humidity level until it reaches the drying front. At this point, it will rapidly cool and its moisture content will increase until it reaches an equilibrium position with the moisture in the grain. After it has emerged from the drying front region, the air temperature and humidity levels remain essentially unchanged until it emerges from the grain bed at the top of the bin.

The temperature to which the air is cooled in this process will depend upon three factors: (1) the temperature at which it enters the drying zone; (2) the amount of moisture the air itself contains as it enters the drying zone; and (3) the moisture content of the damp grain.

In order to avoid the risk of heating the damp grain to a temperature that would promote bacterial and fungal growing, in-bin drying systems that use auxiliary heat usually limit the size of the heat source to what is required to give a temperature rise of about 25° F. In present methods using a fixed input of heat in this way results in air stream temperatures which go from maximum tolerable levels in warm weather to temperatures which are too cool to be effective in cold weather.

In summary, therefore, there appears to be a need to vary the amount of supplemental heat applied in in-bin drying according to fluctuations in ambient temperature, relative humidity, and the moisture level in the grain.

Various attempts have been made to vary the amount of supplemental heat. In Canadian Patent 1,089,952, issued to Elms, a grain dryer using heat sensors in both the material to be dried and in the plenum chamber is disclosed. The sensors are connected to the burner which is a gas burner. The temperature of the air after it has passed through the grain controls an on/off function of the burner. The gas valve control responds to changes in the ambient temperature, changes in the plenum chamber and changes in the gas pressure within the grain. The use of an in-line natural gas burner, however, simply adds excess moisture to the grain, therefore requires drying at higher temperatures which can damage the grain.

In U.S. Pat. No. 4,800,653, issued to Stephan, and entitled METHOD AND APPARATUS FOR CONTROLLING A DRYING AND COOLING OF FIELD HARVESTED SEEDS IN STORAGE, in-bin drying takes place by forcing heated air into a plenum chamber at the bottom of the bin. The heat source is one or more electric heat lamps. The process for controlling the amount of heated air that is introduced into the plenum chamber involves measuring the temperature of the drying air in the plenum chamber after it has passed through the blower, and comparing it with the temperature of the exhaust air leaving the wet grain mass at the top of the bin. If the temperature differential becomes too great the heaters are inactivated.

U.S. Pat. No. 4,558,523, issued to Isbell, for a METHOD AND APPARATUS FOR EQUILIBRIUM DRYING OF GRAIN, a natural gas heater is used to force warmed air into a grain bin having a lower plenum chamber and a perforated floor. The fuel for the heater is limited by a modulating valve which is controlled by a temperature sensing probe in the plenum. In other words, the amount of heat applied is controlled by the temperature of the air after it has passed through the fan into the plenum chamber.

In light of the foregoing, it appears that there is a need to have a truly variable source of supplemental heat which does not involve the use of the direct burning of natural gas, and the blowing of the warmed air directly into the chamber, thereby increasing moisture levels by adding undesirable moisture.

It is an object of the present invention to provide near ideal drying conditions for the grain 24 hours a day while outdoor conditions vary over a wide temperature range.

It is a further object of the present invention to provide a heat source capable of providing a variable output of dry "heat" which can be modulated from 20% to 100% of capacity in a variable boiler in response to the heat required to compensate for fluctuating outdoor air temperatures. The source of heat for the boiler could be natural gas, propane, oil, wood, or coal.

The present invention provides a grain drying system which involves in-bin drying; that is to say, the blowing of warm air into a plenum that distributes the air in a grain bin.

In a simple embodiment of the invention, the floor may simply be perforated, although any configuration which allows the warm blown air to travel through the grain to be dried, can be used. In its simplest configuration, the air circulates up through the grain and out vents at the top or side of the bin. The source of heat is a circulating ethylene glycol solution which is heated by a variable temperature boiler, or more particularly a modulating boiler. The output of the boiler will vary automatically in accordance with the heat requirement which occurs over a continuous range as opposed to a step-wise or off/on system.

In a preferred embodiment, a fixed drying temperature, i.e. a constant temperature of the air leaving the fan coil of approximately 100° F., is used. Because air entering the coil varies with outside temperature, the heat input must be continuously varied over a wide range of outputs. The modulating boiler must be able to produce heat in a capacity of from 20% to 100%, or for example, 100,000 up to 500,000 Btus. Size, of course, may range anywhere from a maximum of 100,000 Btus to 3,000,000 Btus, or more, depending on necessary capacity. Differences in the relative humidity of the air are also important and must be taken into account in setting the temperature of the drying air and in calculating the drying time for the grain in a bin.

In the drying process within the bin the air is cooled due to evaporation of moisture from the grain. The cooling is substantial, as much as 40° F. if the air is very dry. With air entering at 105° F., one could typically have air leave the upper portion of the grain mass at a temperature as low as 65° F. The exhaust air is representative of the temperature in parts of the bin where the grain is still wet. The cooling ensures that the grain that is still high in moisture will not get unduly warm. Growth rates of spores, fungi, bacteria and grain-infesting insects are favored by high temperatures. One must, therefore, be certain that the air which circulates through the grain which has not had an opportunity to dry, should remain relatively cool. Temperatures above 75° F. in the damp regions of the bin should be avoided. The moisture content in the drying air, in turn, is determined by two factors: (1) the relative humidity of the outside air; and (2) any moisture that may be added to the air stream, as in burning gas. Air that has taken in moisture from burning gas will not cool as much as dry air.

In the present invention, the variable boiler heats an enclosed system which is filled with a solution of water and ethylene glycol. The solution is pumped by a cental pump through lines to heat-type exchanger boxes which are connected by duct work to the bin where the grain is to be dried. This system uses low cost polyethylene pipe as conduit for the heat transfer medium. This is not a normal material to use in this type of application. As hydronic heating systems go this system operates at low temperatures and it is this feature that allows the use of low cost polyethylene pipe. Polyethylene pipe has other advantages besides low cost. It is corrosion resistant, inside and out, and when properly installed it has virtually no risk of developing leaks other than by physical damage. The system is quite deliberately engineered to operate with a low temperature heat transfer medium. Coil configuration, air flow and heating fluid flow are designed for relatively low heating fluid temperature and they are balanced so that drying air temperature will track return heating fluid temperature. There are several reasons for this design: (a) it allows the use of low cost yet durable materials, i.e. polyethylene; (b) the design makes it relatively easy to maintain constant drying air temperature from several fan coils without having individual controls in each fan coil; and (c) lower temperature means lower heat loss. The ethylene glycol/water solution passes through a hydronic coil with a blower behind it, or in front of it. The blower draws in outside ambient air, moves it past the hydronic coil, and through the duct work into the bin. The hydronic coil can receive a heated ethylene glycol water solution at any temperature between 95° F to 140° F., depending, of course, on ambient temperature, relative humidity, and moisture in the grain. Preferably, the hydronic coil receives the solution at a temperature that will result in a leaving air temperature of about 100° F. This could be 140° F. or even more in cold weather and be as low as 115° F. in warm weather. It is recommended that the temperature of the blown air entering the plenum area should be between 95° F. and 110° F.

As previously mentioned, when the blown air passes through the damp grain in the drying zone, it picks up moisture and is cooled through evaporation. Preferably, the temperature of the blown air as it leaves the grain mass is approximately 70° F. but this could vary, plus or minus 10° F., depending upon the relative humidity of the outside air and the temperature.

There are several ways of controlling the variable heat boiler but a preferred embodiment of the invention is to sense the temperature of the returning ethylene glycol solution after it has passed through the hydronic coils. The preferred temperature is 115° F. Thus, depending on the temperature of the ambient air, more or less heat will be required in order to maintain the return solution flow at 115° F. A return temperature below 105° F. can be damaging to boilers.

The sensor control for the amount of heat being produced by the modulating boiler can be controlled and be dependent on other factors, for example: (1) ambient air temperature; (2) temperature of the blown air after it has passed through the hydronic coil and moved into the plenum chamber; (3) the temperature of the blown air after it leaves the wet grain mass and travels toward the roof of the grain bin; or (4) as previously mentioned, the temperature of the ethylene glycol solution.

This invention also encompasses other additional features. For example, the heated air could be routed to the top of the grain bin in a reverse flow situation and the air in the plenum could be sucked downwardly through the grain by means of reverse fans. More than one blower can be used to exhaust the air in this situation. This arrangement is also possible in the preferred embodiment where warm dry air is blown into the plenum chamber at the bottom of the bin.

Another feature which conserves energy is the placement of the blower inside the heat-exchanger box where the hydronic coil is located. The additional heat produced by the electric motor of the fan is expelled inside the heat-exchanger box and thus directed to the plenum of the bin rather than being lost to the ambient air.

In colder climates, it is advantageous to place fans on the roof of the bin which blow ambient outside air into the air mass on the top of the grain to be dried. This generally colder and less humid outside air mixes with the humid air leaving the wet grain mass. This lowers the dew point and prevents condensation from forming on the underside of the cold metal roof of the bin.

Therefore, this invention seeks to provide a system for drying grain comprising: a supply of fuel; a variable heat output boiler; at least one enclosed supply line and at least one enclosed return line, filled with a liquid heating-medium; a heating-medium circulation means; at least one fan heat-exchanger coil assembly; said assembly including a blower fan mounted therein and a hydronic heat-exchanger coil; said assembly being in open communication on one side with ambient air and on the other with an air duct; said duct being in open communication with an air plenum located in a grain drying bin; said system further comprising: a temperature sensor, and a fuel supply modulator; wherein, in operation, when said temperature sensor signals that a temperature at a predetermined location falls below a predetermined level, said fuel supply modulator supplies more fuel to said variable boiler thereby increasing Btu output; and when said temperature rises above said predetermined level less fuel is supplied to said boiler thereby decreasing Btu output.

The system further comprises a solution bypass mechanism that senses if the return solution temperature is below 110° F. and if so it progressively opens a bypass valve that allows warm solution leaving the hot side of the boiler to enter directly into the return flow, thus raising its temperature to a level compatible with safe operation of the boiler.

This invention further seeks to provide a method of drying grain in a bin comprising the steps of: (1) heating an enclosed fluid heating-medium in a variable output boiler; (2) circulating said medium through a supply tube to a hydronic heat-exchanger coil; (3) drawing ambient air from outside through said coil by a fan; (4) heating said ambient air by means of said coil, and transferring it, under pressure, to an air plenum in a grain bin; (5) exhausting said air out of the top of said grain bin; (6) returning said fluid heating-medium through an enclosed line to said boiler; (7) sensing the temperature of said returning fluid medium and adjusting the Btu output of said boiler accordingly; (8) further sensing the temperature of the return solution, and if the boiler has been unable to supply sufficient heat to maintain a return temperature of 110° F., said sensing device will cause to open a bypass valve that will allow hot solution leaving the boiler to enter the return stream, thus maintaining minimum solution temperature at the boiler heat exchanger, repeating said steps 1 through 7 continuously until said grain reaches a desired moisture level.

DRAWINGS

The invention will be described in greater detail in connection with the following drawings wherein.

DETAILED DESCRIPTION OF THE DRAWINGS

Figure 1:
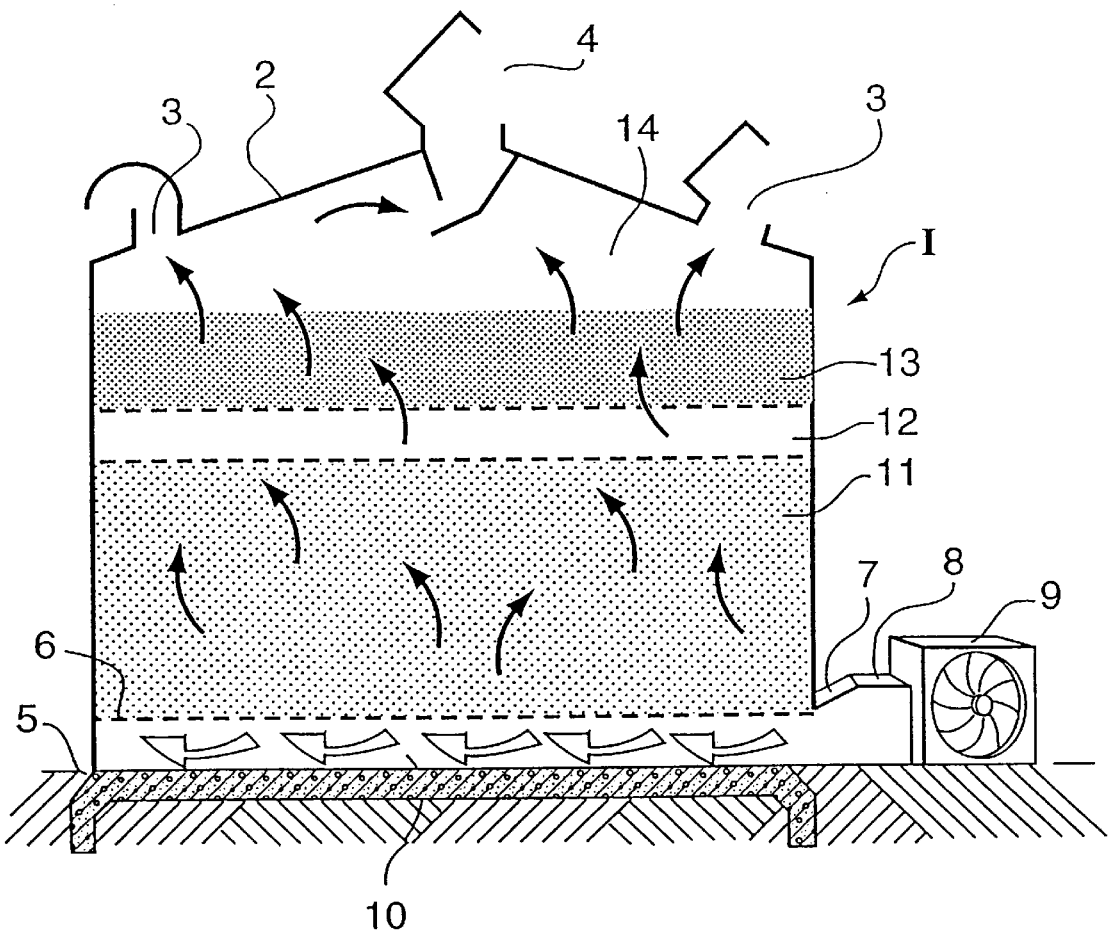
FIG. 1 PRIOR ART
FIG. 1 is a schematic view of a prior art in-bin drying system.

In FIG. 1 a typical grain bin is shown generally as I. It has a roof 2, with roof vents 3, and filler hole 4 for grain entry and exit. It has a perforated floor 6 which permits blown air to pass through. It rests on a base 5. Warmed air passes through in-flow duct 7. This warm air has been heated by a natural gas or propane flame heater 8. Ambient air is drawn in and blown by fan 9 into plenum 10. The air travels from the bottom of the perforated floor 6 upwardly, such that there is a dry grain area 11, a primary drying zone 12, moist grain 13, and an exhaust air area 14. The humid air passes out through vents 3.

As previously mentioned in the general discussion of the difficulties in present grain dryers, the prior art drying system as shown in FIG. 1 has three major drawbacks, namely: (1) the products of combustion of the fuel, natural gas, propane or other fuel, are sent directly into the grain. These combustion products contain copious quantities of water vapor that reduce the drying capacity of the air, and they may contain other combustion products injurious to grain quality; (2) these systems do not allow for control of drying air temperature over a wide range of outdoor air temperatures. Thus, the temperature of the blown air will vary with changes in the outside ambient temperature such that the temperature of the air entering the dry grain mass may be too high or too low for proper drying; and (3) because these systems depend on an open flame in the air stream that leads to a flammable material they present a fire hazard and require constant monitoring.

Figure 2:
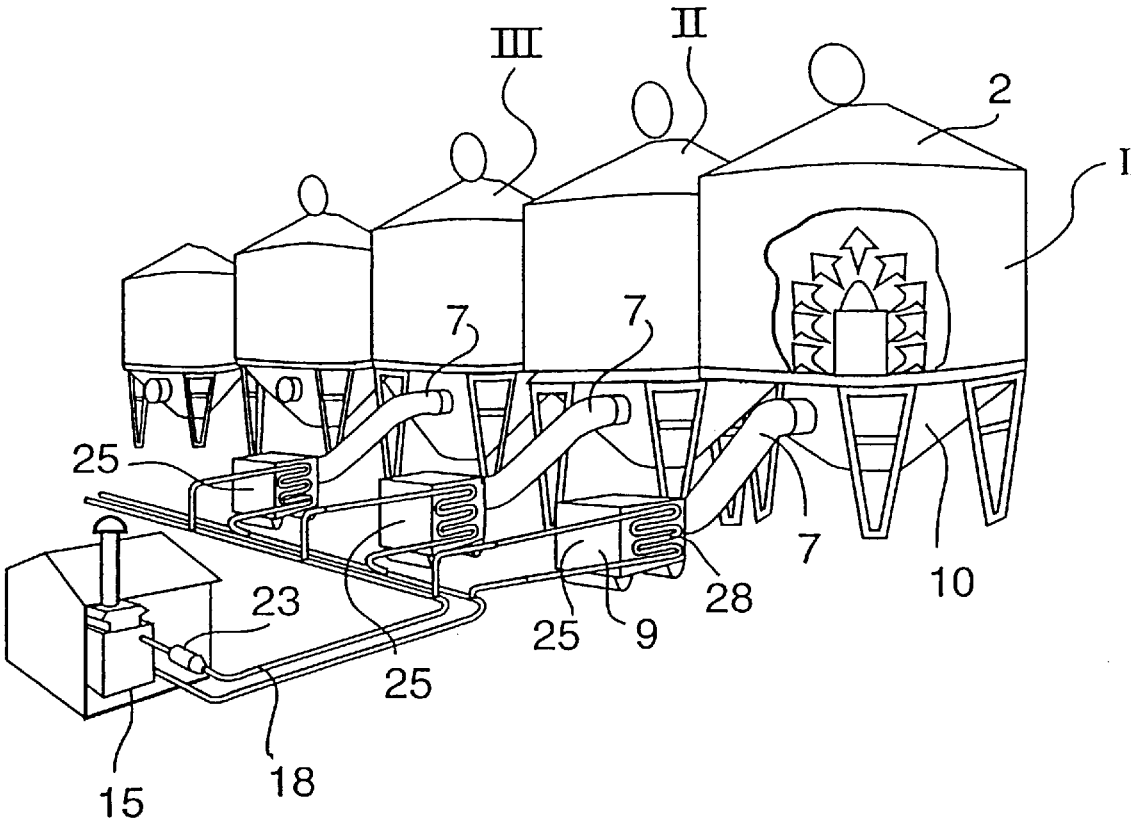
FIG. 2 is a perspective view of a drying system of the present invention.

In FIG. 2, the basic components of the present invention are shown. A modulating boiler 15 heats an enclosed system of water/ethylene glycol solution which is moved through supply tube 18 via circulating pump 23, to a hydronic coil 28 housed within a dryer fan coil assembly 25. An enclosed fan 9 (not visible in FIG. 2) draws ambient air through the hydronic coil, warming it and thereafter blowing it through supply duct 7 into plenum 10 of bin I. Similarly, bins II and III are also supplied with warm dry air.

Figure 3:
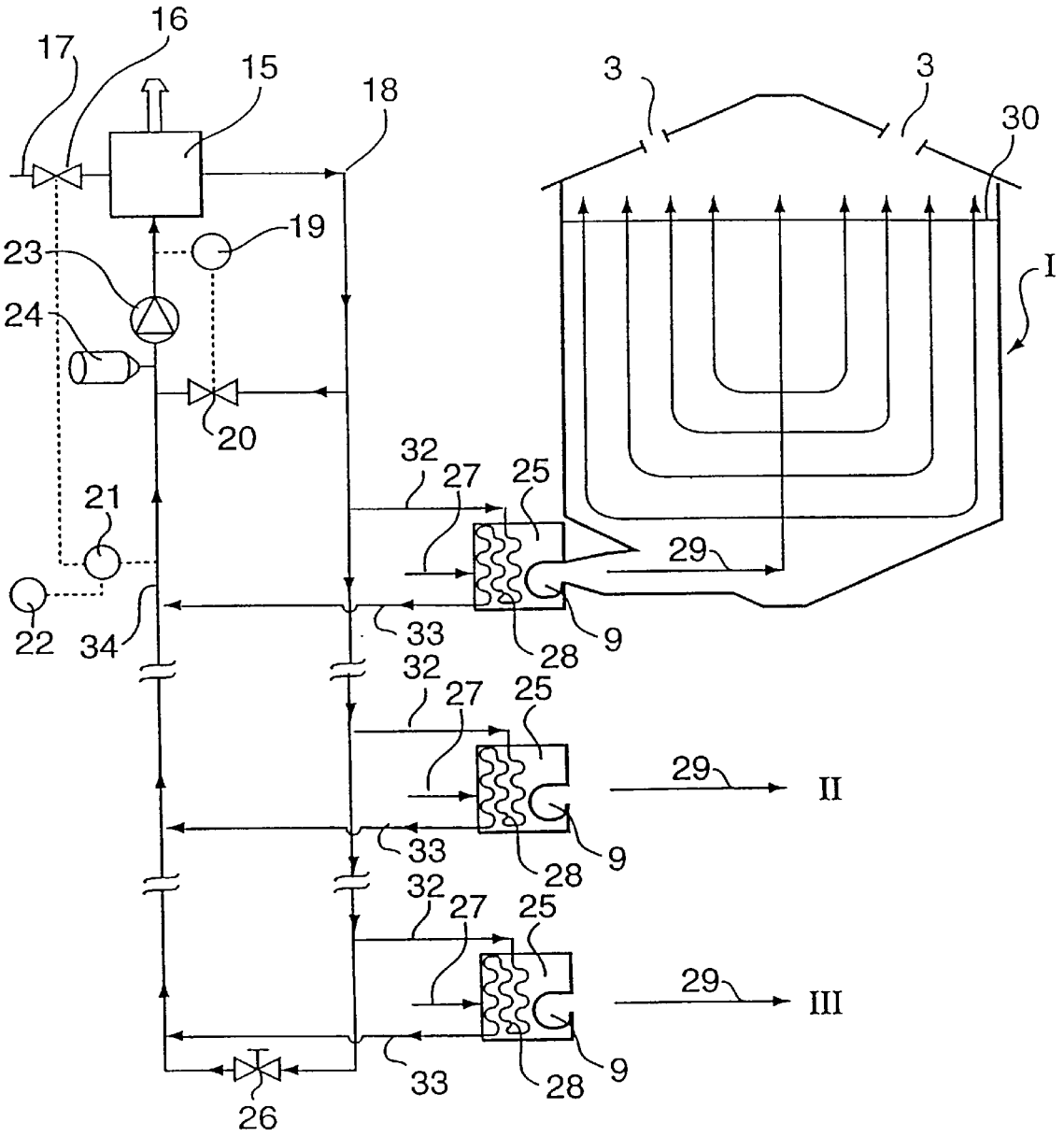
FIG. 3 is a schematic view of the same invention.

In FIG. 3, the major components and controls of the apparatus of the present invention are seen. The ethylene glycol/water solution is heated in modulator boiler 15. The output of modulating boiler 15 is controlled by fuel supply modulator 16 which takes a supply of conventional fuel such as oil, propane, or natural gas, through line 17. The liquid heating-medium, after passing through modulator boiler 15, passes through supply line 18, and thereafter through secondary supply lines 32 into hydronic coils 28, housed in dryer fan coil assemblies 25. Thereafter the heated liquid medium goes through secondary return lines 33 back to modulating boiler 15 through primary return line 34.

The liquid ethylene glycol water heating medium is moved by a master circulating pump 23. In the primary return line 34 is located a return medium temperature sensor 21 which senses the temperature and, based on the temperature observed, activates the modulating valve of the boiler 16, increasing or decreasing the fuel supply so as to maintain a constant return temperature in the return heating medium. In the event that the heat required that sustains constant temperature is greater than the capacity of the boiler, a second temperature sensor in the line 19 senses the temperature downstream from modulation control sensor, and if the temperature is insufficient, it will activate a bypass valve 20 which will allow some hot fluid from the supply line 18 to circulate immediately back to fluid to the return line thus ensuring that a minimum temperature is maintained in the heating medium before it enters the boiler. The system is also equipped with heating-medium expansion reservoir 24 and a pressure balance valve 26.

In FIG. 3, ambient air 27, is drawn through hydronic coils 28 by a fan 9, and thereafter the heated dry air 29 is pushed into plenum 10 of bin I. Although not shown, bins II and III are similarly equipped. The air passes through the grain, up into the exhaust area above upper grain bed level 30, and out through roof vents 3.

In operation, the temperature of the heating-medium is varied in accordance with the preferred temperature of 115° F. of the return heating medium after passing through the hydronic coils. Thus, if the return heating-medium flowing through primary return line 34 is less than 115° F., the amount of fuel supplied by fuel supply modulator 16 will be increased. Similarly, if the temperature of the return heating-medium is above 115° F., the fuel supply will be decreased. Thus, there is a constant increase or decrease in the output of the modulating boiler 15, depending upon ambient temperature.

Figure 4:
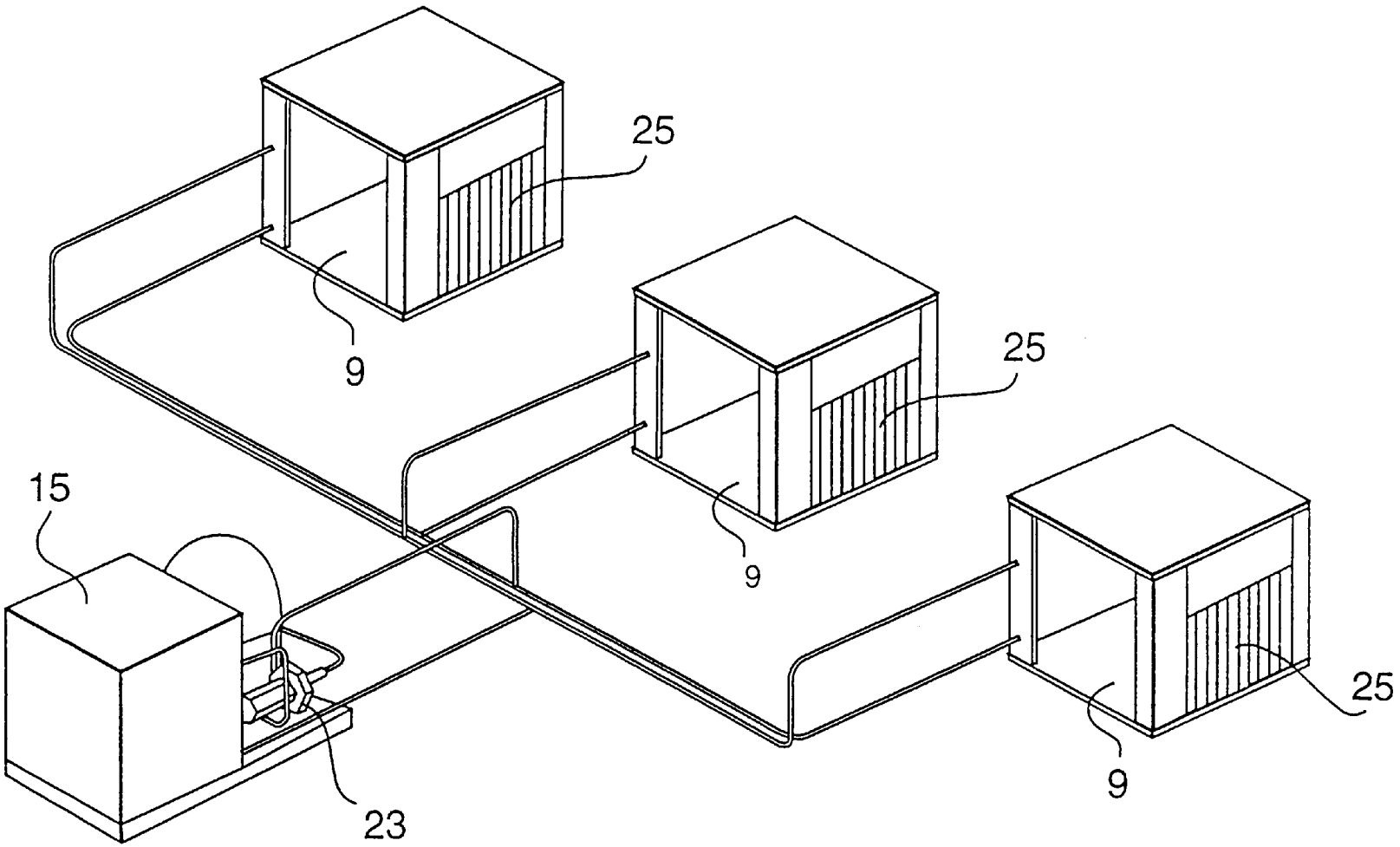
FIG. 4 is a perspective view of the fluid heating medium supply lines, boiler, and fan/coil boxes.

FIG. 4 shows a typical layout for one boiler 15 and three hydronic coil/fan assemblies 25.

Figure 5:
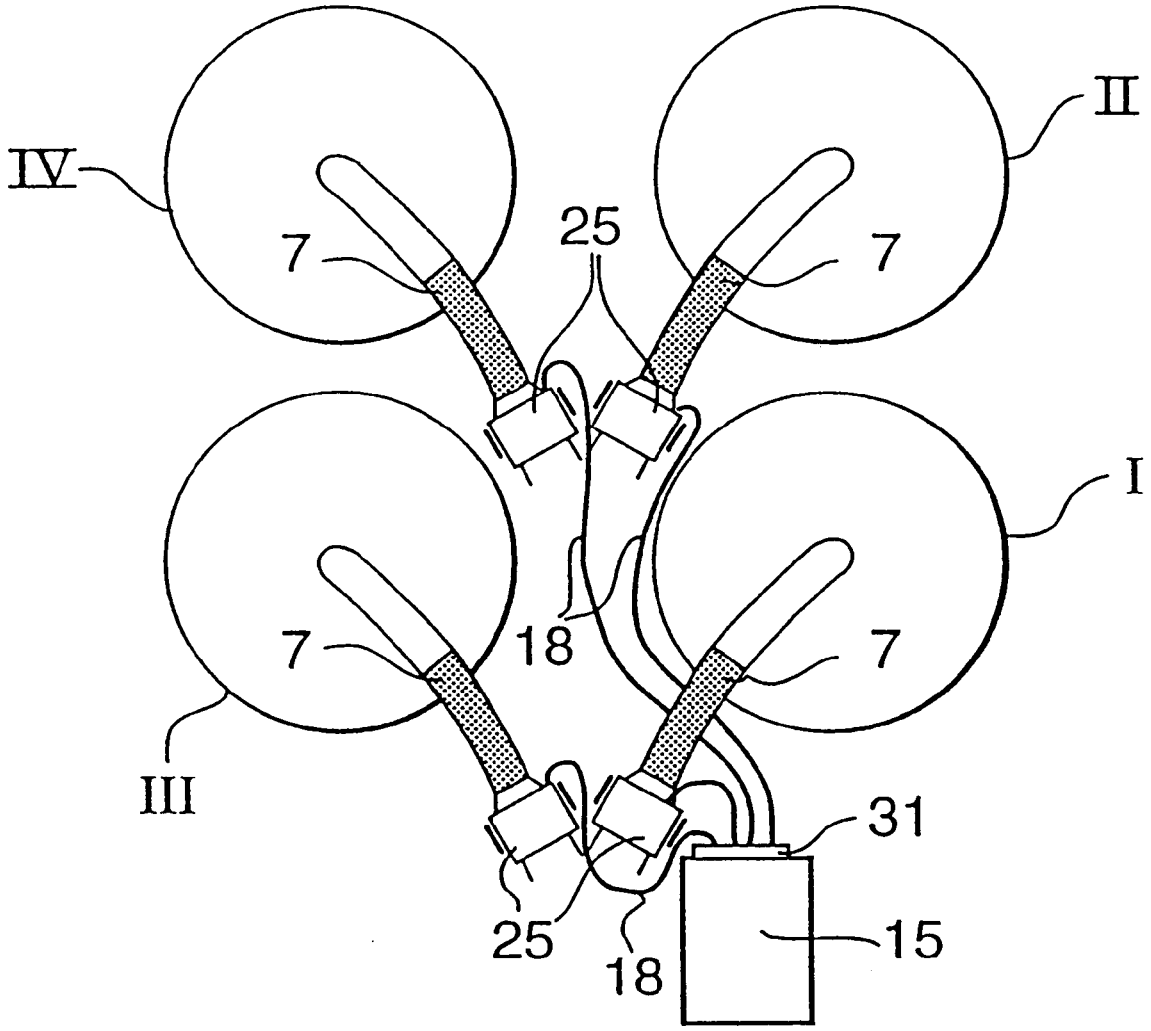
FIG. 5 is a schematic view of a site layout for the present invention.

FIG. 5 is a top schematic view of a typical layout for a grain drying system. One notes that grain drying bins I, II, III, and IV, each have an air duct 7 leading thereto. The liquid ethylene glycol heating-medium is heated in modulating boiler 15 and thereafter passes out manifold 31 to supply lines 18 to fan/coil assemblies 25. The warmed dry air thereafter passes through in-flow ducts 7 into the plenums of the bins I, II, III and IV (plenums not shown).

A chart which outlines emerging air temperatures as a function of outdoor temperature and humidity, is attached.

In summary, the present invention offers a method of drying grain using a simple self-contained apparatus which is totally automatic and which maintains the drying ability of the system at a constant, regardless of fluctuations in outdoor temperature.

Sizing

Dryer Performance Calculator

| INPUTS | Enter | Default | OUTPUTS | |
|---|---|---|---|---|
| Model # | 9000 | none | Boiler max input BTUH | 627000 |
| Outdoor temp | 50 | none | Drying capacity lbs water/hour | 260 |
| Outdoor relative humidity | 50% | 50% | Drying output (point-bushels/day) | 10406 |
| Cost of nat gas ($/cu meter) | | none | Boiler capacity being utiised | 94% |
| Cost of propane ($ per liter) | 0.38 | none | Gas costs per point bushel | 0.02048 |
| Cost of electricity | 0.08 | 0.07 | Electrcity costs per point bushel | 0.00293 |
| Number of modules | 3.0 | none | Total costs per point bushel | 0.02341 |
| CFM per module | 2500 | 2500 | Emerging air temperature | 69 |
| Desired drying temperature | 105 | 105 | Emerging air dew point | 60 |
| | | | Total cfm | 7500 |
| | | | Max. usable cfm at condition | 7950 |

Emerging Air Temperature as a Function Outdoor Temperature and Humidity

| | | Outdoor Temperature | | | | | | | | | |
|---|---|---|---|---|---|---|---|---|---|---|---|
| | 69 | 0 | 10 | 20 | 30 | 40 | 50 | 60 | 70 | 80 | 90 |
| HUMIDITY | 10% | 63 | 63 | 63 | 63 | 63 | 64 | 64 | 65 | 66 | 68 |
| | 20% | 63 | 63 | 63 | 64 | 64 | 65 | 66 | 68 | 70 | 73 |
| | 30% | 63 | 63 | 64 | 64 | 65 | 66 | 68 | 70 | 73 | 77 |
| | 40% | 63 | 63 | 64 | 65 | 66 | 68 | 70 | 73 | 76 | 81 |
| | 50% | 63 | 64 | 64 | 65 | 67 | 69 | 72 | 75 | 79 | 85 |
| | 60% | 63 | 64 | 65 | 66 | 68 | 70 | 73 | 77 | 82 | 88 |
| | 70% | 63 | 64 | 65 | 67 | 69 | 71 | 75 | 79 | 85 | 91 |
| | 80% | 64 | 64 | 65 | 67 | 69 | 72 | 76 | 81 | 87 | 94 |
| | 90% | 64 | 65 | 66 | 68 | 70 | 73 | 78 | 83 | 89 | 97 |
| | 100% | 64 | 65 | 66 | 68 | 71 | 75 | 79 | 85 | 92 | 99 |

Incoming air temperature is 105 degrees fahrenheit

Do not use conditions that give emerging air temperatures over 80 degrees Fahrenheit The embodiments of the invention in which an exclusive property or privilege is claimed are defined as follows:

1. A system for drying grain comprising:

a supply of fuel;

a variable heat output boiler;

at least one enclosed supply line and at least one enclosed return line, filled with a liquid heating-medium;

a heating-medium circulation means;

at least one fan heat-exchanger coil assembly;

said assembly including a blower fan mounted therein and a hydronic heat-exchanger coil;

said assembly being in open communication on one side with ambient air and on the other with an air duct;

said duct being in open communication with an air plenum located in a grain drying bin;

said system further comprising:

a temperature sensor, and a fuel supply modulator; wherein, in operation, when said temperature sensor signals that a temperature at a predetermined location falls below a predetermined level, said fuel supply modulator supplies more fuel to said variable boiler thereby increasing Btu output; and when said temperature rises above said predetermined level less fuel is supplied to said boiler thereby decreasing Btu output.

2. A system as claimed in claim 1 wherein said predetermined location is outside ambient air.

3. A system as claimed in claim 1 wherein said predetermined location is within said air plenum in said bin.

4. A system as claimed in claim 1 wherein said predetermined location is within a grain mass within said bin.

5. A system as claimed in claim 1 wherein said predetermined location is within said bin above a grain bed and below a roof of said bin.

6. A system as claimed in claim 1 wherein said predetermined location is within said return line filled with said liquid heating-medium.

7. A system as claimed in claim 1, wherein said air plenum is located at the bottom of said grain drying bin;

said plenum being separated from grain to be dried by a porous floor.

8. A system as claimed in claim 1, wherein said air plenum is located in the upper portion of said bin above the level of grain to be dried.

9. A system as claimed in claim 1, wherein said bin includes fans in apertures in the roof of said bin;

said fans, when in operation, being adapted to move outside ambient air into an area of said bin above the level of grain to be dried.

10. A system as claimed in claim 1, wherein said liquid heating-medium is a solution of water and ethylene glycol.

11. A system as claimed in claim 1 further comprising a second temperature sensor in said return line, and a bypass valve in a bypass line, wherein, in operation, when temperature falls below a predetermined level in said return line, said sensor activates said bypass valve permitting heated ethylene glycol/water solution from said supply line to flow directly through said bypass line to said return line.

12. A system for drying grain comprising:

a supply of fuel;

a variable heat output boiler;

an enclosed supply line and an enclosed return line filled with a liquid heating-medium;

a heating-medium circulation means;

at least one fan/heat-exchanger coil assembly;

said assembly including a blower fan mounted therein and a hydronic heat-exchanger coil;

said assembly being in open communication on one side with ambient air and on the other with an air duct;

said duct being in open communication with an air plenum located in a grain drying bin;

said system further comprising a heating-medium temperature sensor, and a fuel supply modulator; wherein, in operation, when said heating-medium in said return line falls below a predetermined temperature, said fuel supply modulator supplies more fuel to said variable boiler, thereby increasing Btu output, and when said heating-medium in said return line rises above said predetermined temperature less fuel is supplied to said boiler, thereby decreasing Btu output.

13. A system as claimed in claim 12, wherein said predetermined temperature is between 90° F. and 110° F.

14. A system as claimed in claim 12, including:

a plurality of fan heat-exchanger coil assemblies;

a plurality of air ducts; and a plurality of bins.

15. A system as claimed in claim 12 wherein said enclosed supply line and enclosed return line are constructed of polyethylene pipe.

16. A method of drying grain in a bin comprising the steps of:

(1) heating an enclosed fluid heating-medium in a variable output boiler;

(2) circulating said medium through a supply tube to a hydronic heat-exchanger coil;

(3) drawing ambient air from outside through said coil by a fan;

(4) heating said ambient air by means of said coil, and transferring it, under pressure, to an air plenum in a grain bin;

(5) exhausting said air out of the top of said grain bin;

(6) returning said fluid heating-medium through an enclosed line to said boiler;

(7) sensing the temperature of said returning fluid medium and adjusting the Btu output of said boiler accordingly;

(8) repeating said steps 1 through 7 continuously until said grain reaches a desired moisture level.

* * * * *